United States Patent [19]

Guiraud

[11] 4,044,578

[45] Aug. 30, 1977

[54] SAFETY LOCK

[75] Inventor: François Guiraud, Chambourcy, France

[73] Assignee: Fichet-Bauche, Velizy, France

[21] Appl. No.: 647,975

[22] Filed: Jan. 9, 1976

[30] Foreign Application Priority Data

Jan. 17, 1975 France ..... 75.01552

[51] Int. Cl.[2] ..... E05B 19/06; E05B 29/06

[52] U.S. Cl. ..... 70/366; 70/401; 70/409

[58] Field of Search ..... 70/366, 365, 358, 401, 70/407, 409, 411, 419

[56] References Cited

U.S. PATENT DOCUMENTS 2,685,192 8/1954 Salle ..... 70/358

FOREIGN PATENT DOCUMENTS 330,120 12/1920 Germany ..... 70/366
911,220 5/1954 Germany ..... 70/366
2,062,074 6/1972 Germany ..... 70/366

*Primary Examiner*—Robert L. Wolfe
*Attorney, Agent, or Firm*—Kane, Dalsimer, Kane, Sullivan & Kurucz

[57] ABSTRACT

A safety lock and its actuation key are disclosed. The lock comprises an apertured barrel mounted in a cylinder which barrel can be rotated with respect to the cylinder when notched cams inside said barrel have their notches aligned, so that by rotating the key at least one longitudinal catch placed between the barrel and said cylinder can take place into said aligned notches. The apertures form two couples of shanks perpendicular to a central channel for the key body and the shanks of a couple are offset in height with respect to one another.

6 Claims, 21 Drawing Figures

VI
VI

SAFETY LOCK

The invention refers to a safety lock.

Safety locks are already known wherein the displacement of a key inserted into a barrel actuates, through teeth of different height, cam plates fitted into the barrel and having at least one notch on their periphery, so that for the position of maximum penetration of the key, the plates held by the barrel are moved, by means of the teeth with which they cooperate in this final position, to positions where their notches are aligned, so that by rotating the key, at least one longitudinal catch which rotatively interlocked the barrel with a fixed peripheral cylinder, can then take place into the notches then aligned of the plates, and thus release the barrel with respect to the cylinder, the rotation of the barrel actuating the opening mechanism of the key.

Such locks have found and still find a very broad application in view of the safety they provide, and also due to the fact that they allow manufacturing locks with hierarchically classified keys, i.e. systems where specified keys open all locks from a lock group, other keys open only keys from a sub-group and eventually still other keys only open locks from a sub-sub-group of locks.

The invention refers to a lock belonging to the type of locks defined herebefore and which offers, compared with the latters, important advantages specially in relation with safety, also with the easiness of manufacture and also with the adaptivness to various conditions of use.

It refers to a lock of this type having several series of plates respectively cooperating with the teeth of several key cogs and it is characterized by the fact that the channels of the barrel intended for inserting the key are offset in height with respect to one another. Opening of the lock without a key is thus made even more difficult.

According to a characteristic of the invention, the barrel consists of a stacking of a plurality of disks, which allows to implement with analog or identical disks, more or less complex locks.

Moreover, the invention contemplates to manufacture the housings for the plates or cams which can be actuated by the key, when inserted, from recesses provided on opposite surfaces of the disks. Manufacturing of the barrel is thus appreciably simplified.

The following description, given by way of example, is made with reference to the appended drawing, wherein.

Figure 2:
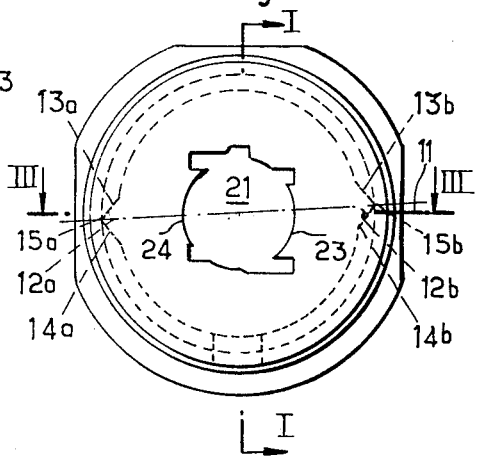
FIG. 2 is a front view of the lock body.
Figure 2:
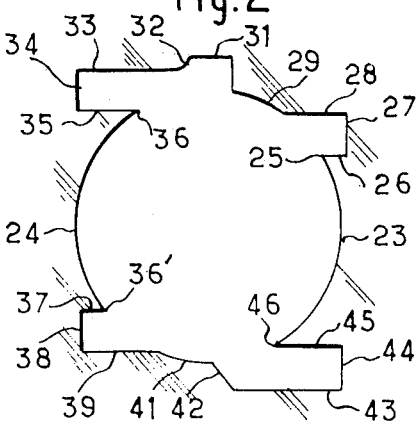
Figure 3:
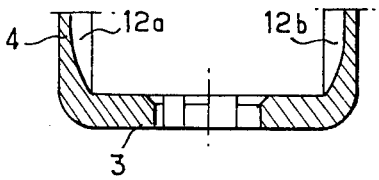
Figure 4:
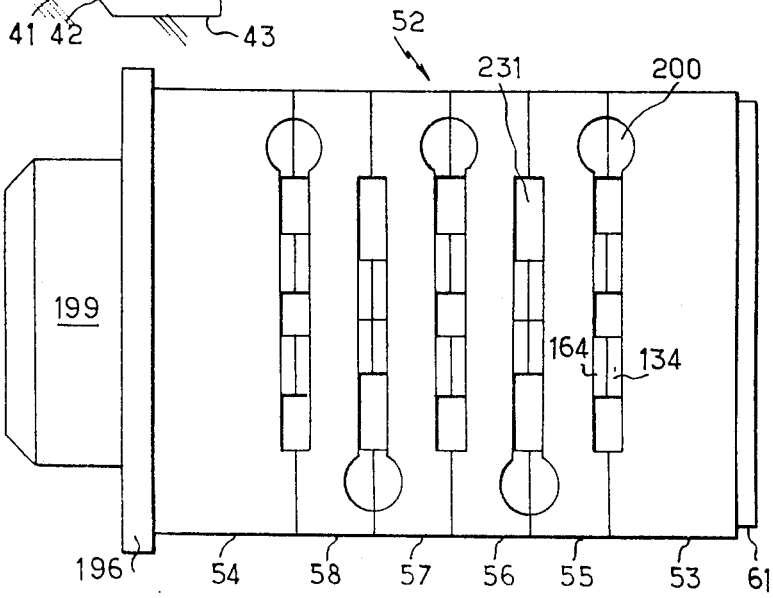
Figures 5, 6:
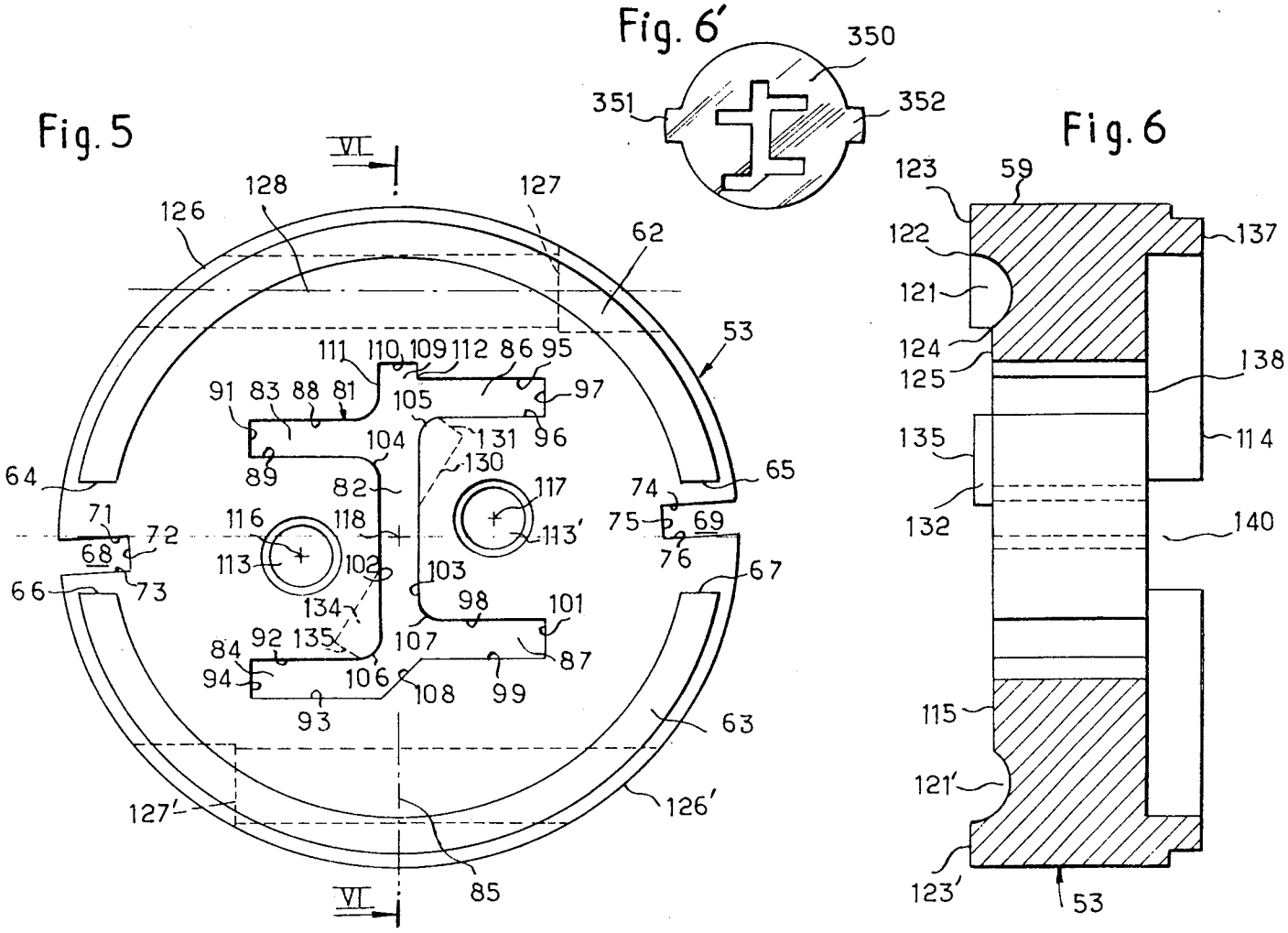
Figure 8:
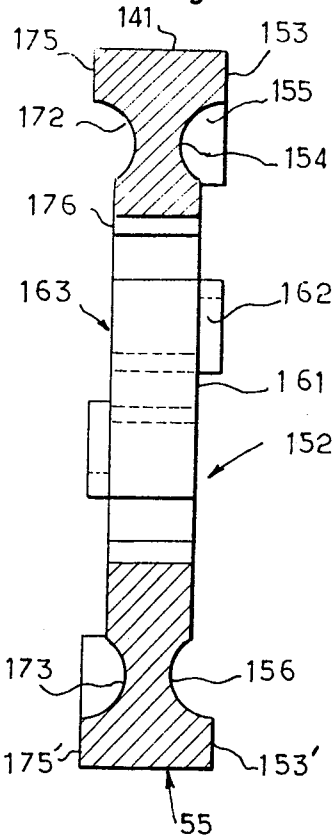
Figure 7:
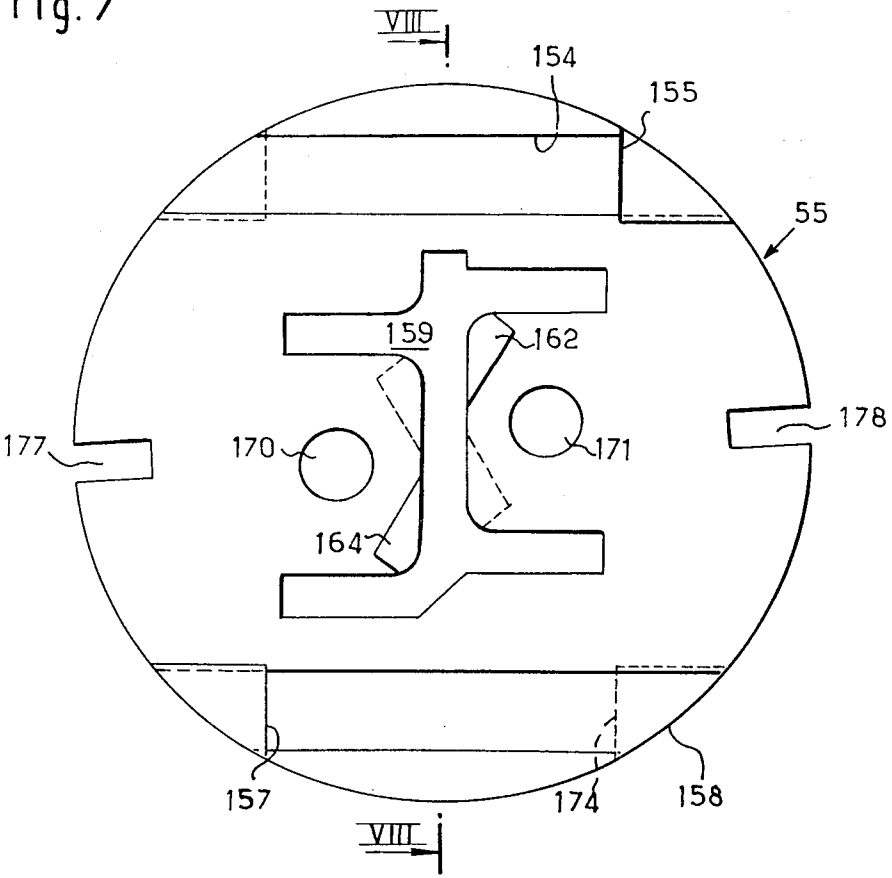
Figure 10:
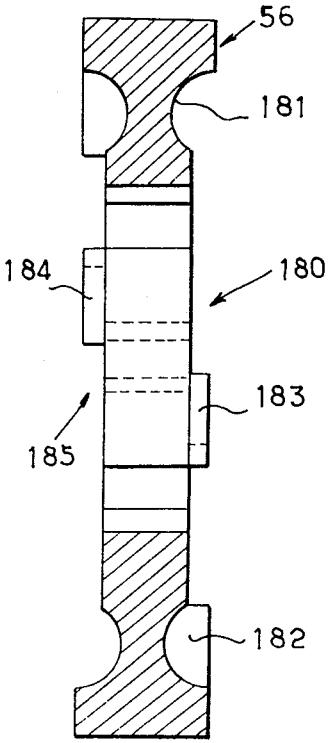
Figure 9:
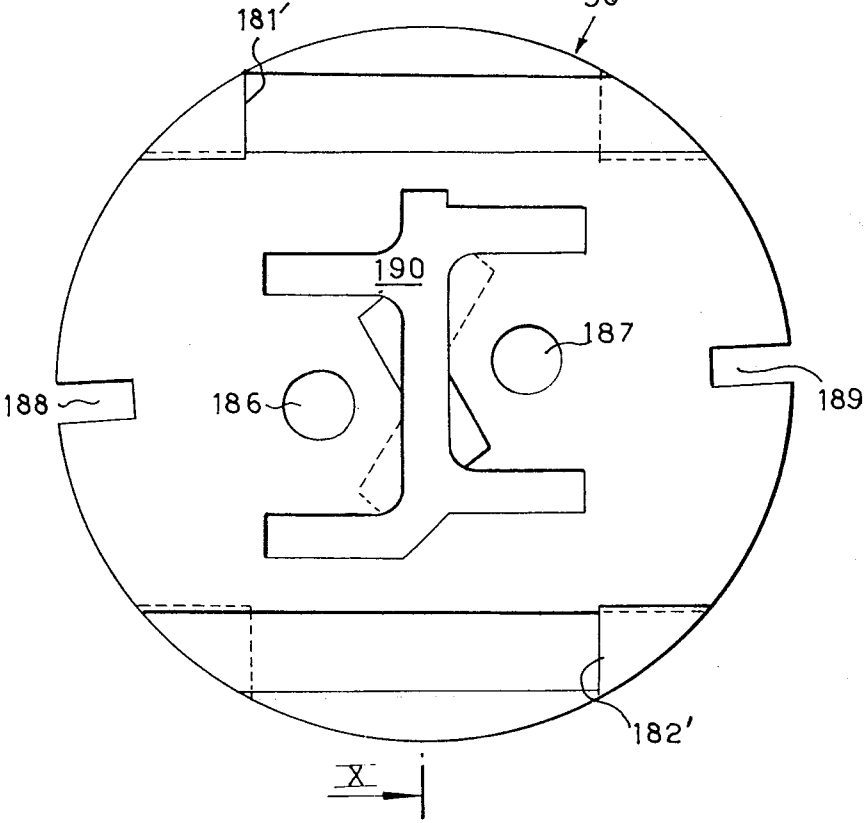
Figure 12:
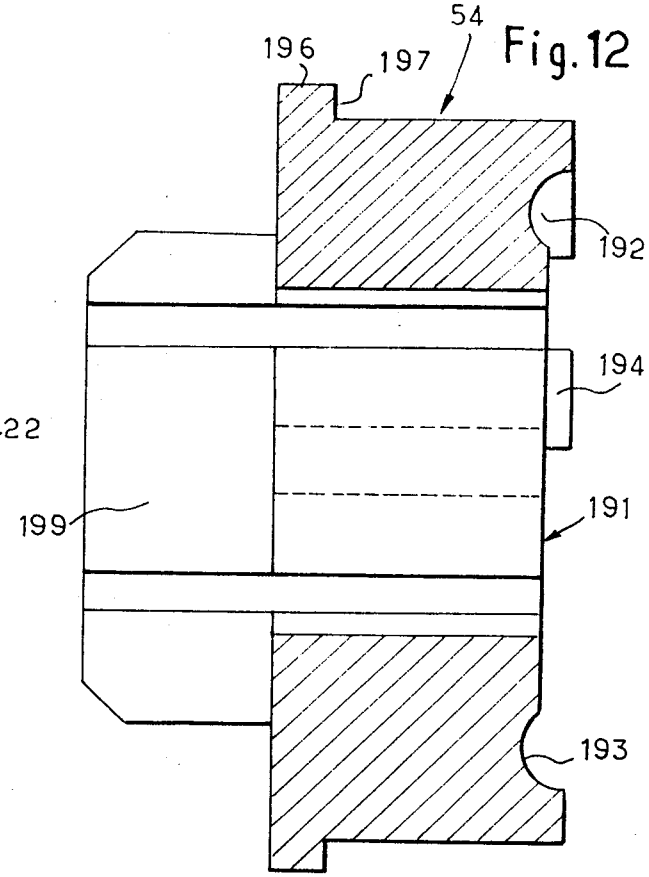
Figure 11:
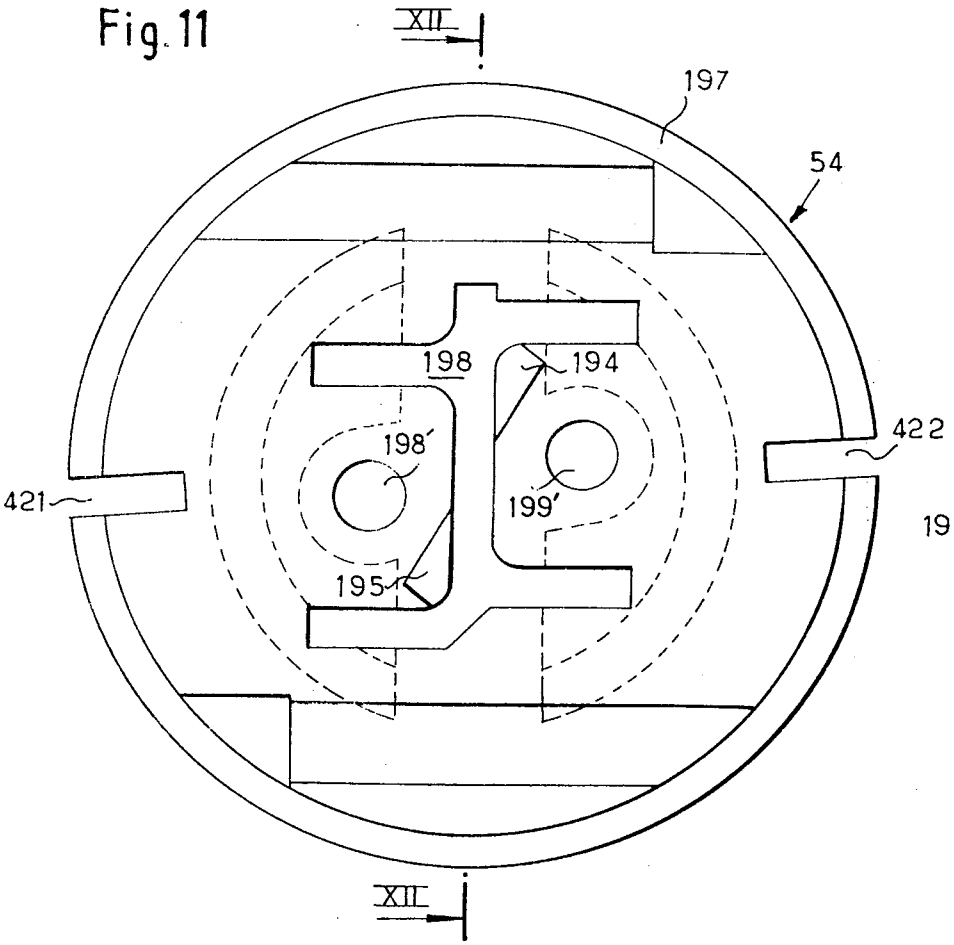
Figure 14:
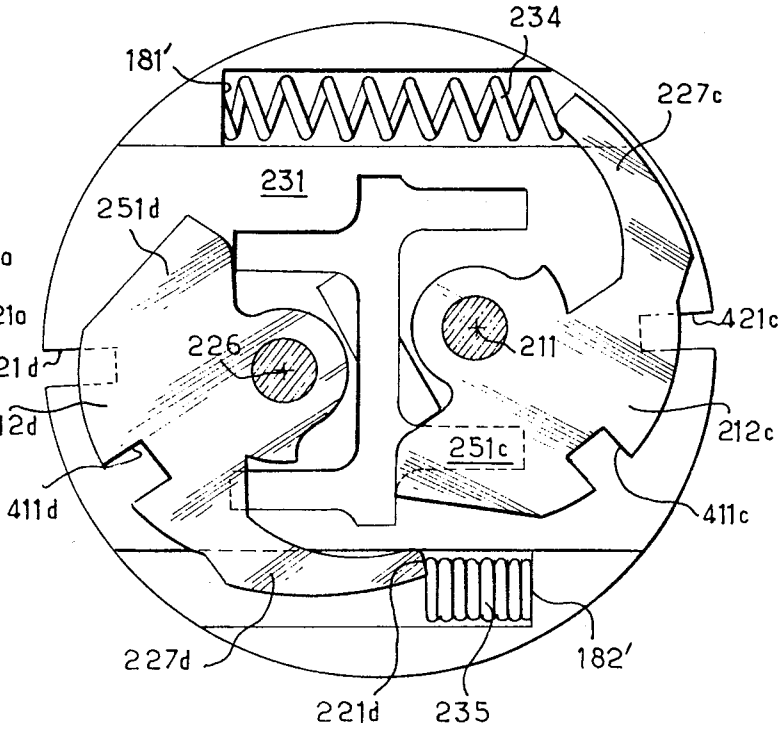
Figure 13:
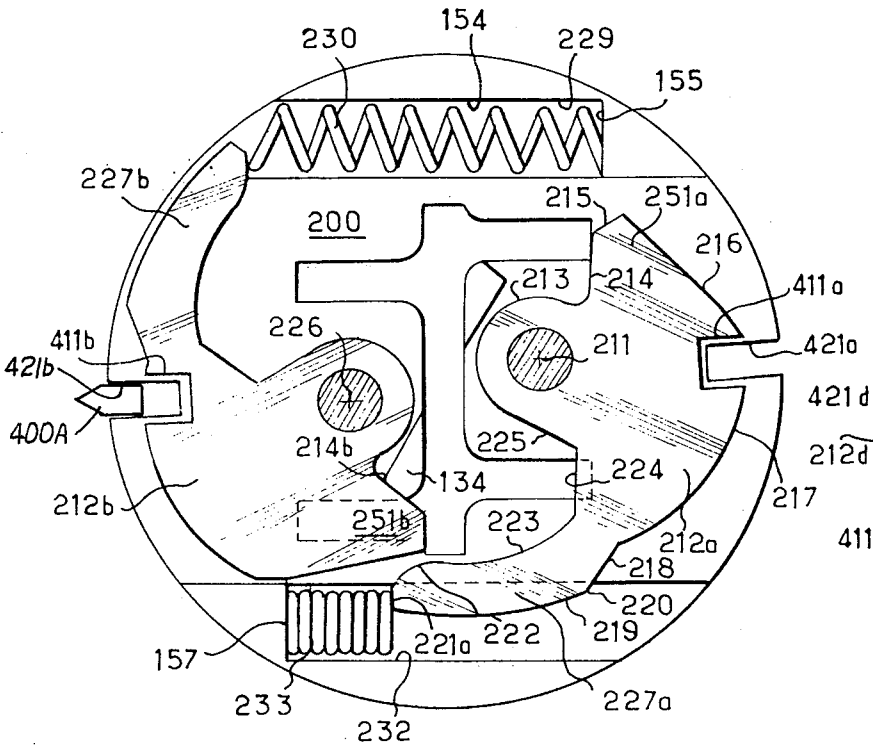
Figure 15:
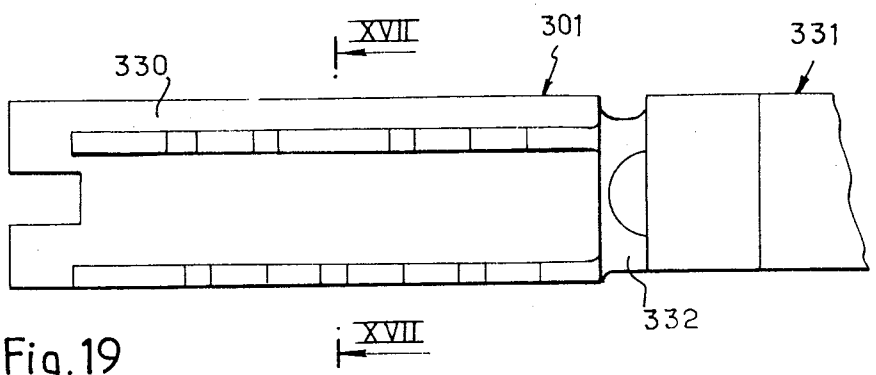
Figure 16:
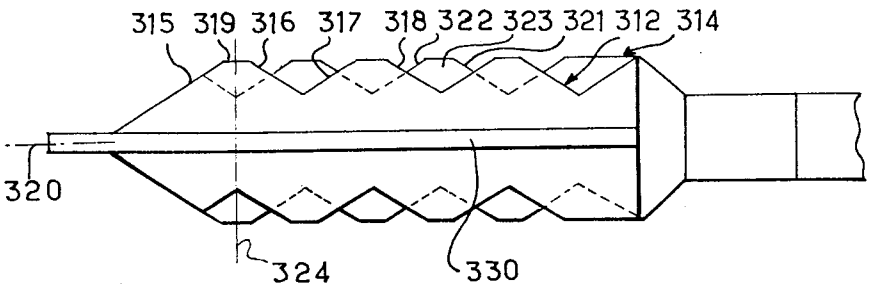
Figure 19:
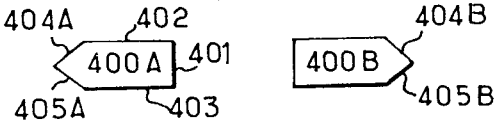
Figure 17:
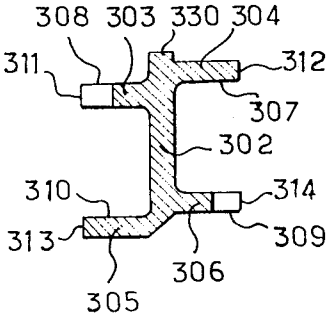
Figure 18:
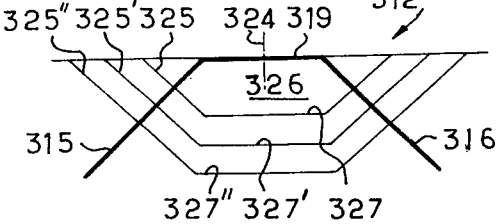

FIG. 2' is a large scale view of the lock key-hole;

FIG. 3 is a sectional partial view along line III—III of FIG. 2;

FIG. 4 is a side view of a barrel device according to the invention;

FIG. 5 is a front view of a member or key-hole end disk of the barrel device;

FIG. 6 is a sectional view along line VI—VI of the FIG. 5;

FIG. 6' is a front view of a protective plate applied to the front face of the member shown on FIG. 5;

FIG. 7 is a front view of a second member of disk of the barrel device;

FIG. 8 is a sectional view along line VIII—VIII of FIG. 7;

FIG. 9 is a front view of a third member of the barrel device;

FIG. 10 is a sectional view along line X—X of the FIG. 9;

FIG. 11 is a front view of the last member of the barrel device;

FIG. 12 is a sectional view along line XII—XII of the FIG. 11;

FIG. 13 is a front view of the second disk seen from its face opposite to the key-hole, together with its mechanisms or components;

FIG. 14 is a front view of the third member or disk belonging to the barrel device together with its mechanisms and components;

FIG. 15 is a front view of a key for actuating the lock before it being cut;

FIG. 16 is a corresponding plan view of the key for actuating the lock;

FIG. 17 is a sectional view along line XVII—XVII of FIG. 15;

FIG. 18 is a larger scale view illustrating schematically the cutting of a tooth into a key edge;

FIG. 19 is a schematic view of catches.

Figure 1:
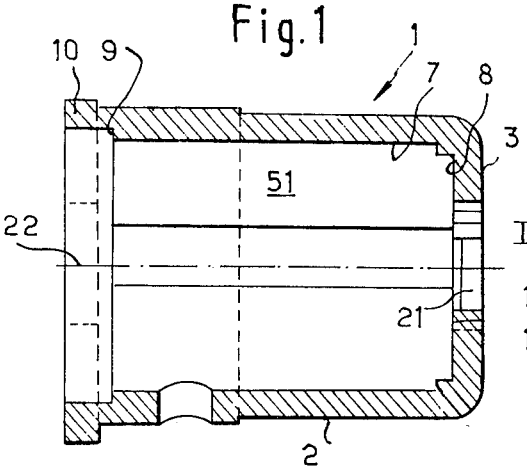
FIG. 1 is a cross-section view along line I—I of the cylinder body of the lock illustrated in FIG. 2.

The lock has a cylinder 1 (FIG. 1 to 3) consisting of a cylinder body 2 having its front part closed by a wall 3 and a back part open. The internal surface 7 of the body 2 is a cylindrical surface of uniform diameter from the internal transverse face 8 of the wall 3 up to a recess 9 limiting an end annular part 10 for the cylinder body.

The internal surface 7 has two notches **12*a*, 12*b* at the extremities of a diametral plane 11, these notches being bevel-shaped and limited by faces 13*a*, 14*a* and 13*b*, 14*b* respectively connected along rectilinear edges 15*a*, 15*b* located in the diametral plane 11, with faces 13 and 14** being mutually at a slightly obtuse angle.

The wall 3 has a key-hole 21 of a generally circular shape, having an axis alined with the axis 22 of the cylinder body 2. The edge limiting the key-hole 21 has a number of circular parts and rectilinear parts, the circular parts being centered on the axis 22. Two circular arcs 23 and 24 are symmetrical with respect to axis 22 and to the extremity 25 (upper end on the Figure) of arc 23 is adjacent a short rectilinear horizontal side 27 to which is connected a rectilinear vertical side 28, connected itself to an horizontal side 28. The side 28 is connected to a circular arc 29, having a smaller span than the arc 23, and which is extended by a rectilinear side 31 connected through a curved section 32 to an horizontal rectilinear side 33. To this side is connected a vertical side 34 connected itself to an horizontal side 35, shorter than the side 33, the extremity 36 of which is the upper extremity of the arc 24. The other extremity 36' of the arc 24, symmetrical of the extremity 25 with respect to axis 22, is connected to a rectilinear side 37, symmetrical of side 26, and which is connected to a vertical rectilinear side 38, symmetrical of side 27, which extends by a rectilinear side 39 symmetrical of side 28. The rectilinear side 39 is connected to a circular arc 41 connected through an oblique rectilinear section 42 to a horizontal side 43 symmetrical of side 33 and which is connected with a vertical side 44 symmetrical of side 34, which is connected to an horizontal side 45 the extremity 46 of which is the lower end of the arc 23.

A barrel device 52 (FIG. 4) is located into the cylindrical space 51 provided by the cylinder 1, this barrel being made of a plurality of stacked members, namely a member or disk 53 at the key-hole extremity, on the opposite side a member 54, and between member 53 and member 54 a number of stacked members or disks identical or quasi-identical to one another (four in the illustrated example, 55, 56, 57 and 58).

Member 53 (figures 5 and 6) is generally disk-shaped. Its external side surface 59 matches the internal surface 7 of the cylinder 2. The front face of member 53 has two semi-circular annular ribs 62 and 63 limited respectively by end faces 64, 65 and 66, 67. In the gap between these end faces, the member 53 has rectangular notches 68 and 69, diametrically opposite and limited by plane faces respectively 71, 72, 73 and 74, 75 and 76.

Member 53 is crossed right through by a channel 81 which has, from each side of a vertical rectilinear channel (on the drawings) 82, an horizontal channel or upper shank 83 and a lower shank 84, on one side of the mean plane 85 of channel 82, and an upper shank 86 and a lower shank 87 on the other side. The upper shank 86 is at a higher level than the upper shank 83 and the lower shank 87 is at a higher level than the lower shank 84.

The shank 83 is limited by horizontal rectilinear edges 88 and 89 connected by a vertical edge 91. The lower shank 84 is limited by rectilinear edges 92 and 93 connected by a vertical edge 94. Similarly, the shank 86 is limited by horizontal edges 95 and 96 connected by a vertical edge 97 and the shank 87 is limited by horizontal edges 98 and 99 connected by a vertical edge 101. The level of the edge 96 is not lower than that of edge 88 and the level of the edge 92 is not higher than that of edge 99.

Edges 102 and 103 of the vertical section 82 of the channel are connected through curved sections 104, 105, 106, 107 to the horizontal shanks 83, 86, 84, 87. Edges 93 and 99 of shanks 84 and 87 are connected by an oblique rectilinear edge 108. The vertical part 82 of the channel extends by a portion 109 limited by an horizontal edge 110 and two vertical edges 111 and 112.

The member 53 is crossed right through by a first cylindrical hole 113 and a second hold 113' opening onto the front face 138 and the back face 115 of the member. These holes have their axis 116 and 117 parallel to the axis 118 of the member. The axis 116 is located substantially at equal distance from shanks 86 and 87 and the axis 117 is located substantially at equal distance from shanks 86 and 87 and they are from each side of the horizontal diametrical plane 118 of the member.

In its peripheral section, member 53 has on its back face a groove 121, substantially semi-cylindrical, with its axis parallel to the diametrical plane 118 the upper edge 122 of which is that of its intersection with a peripheral portion 123 of the back face, while on the opposite edge 124 of the groove is that of its intersection with the central portion 125 of the back face 115 of the member, recessed with respect to the peripheral portion 123. The groove 121 opens onto the side surface 59 at one of its extremities 126. Its other extremity is closed by a bottom part 127 perpendicular to the axis 128 of the groove.

Member 53 has, on its back face 115, a lower portion 123' symmetrical to the upper part 123 with respect to plane 118 and this lower portion features a groove 121', of a span lower than an half-circle, symmetrical to the groove 121 with respect to the diametrical plane 118, opening at an extremity 126' symmetrical to the extremity 126 with respect to the axis of the member and obturated at its other extremity by a bottom part 127' symmetrical to the bottom part 127 with respect to said axis.

The central section 125 of the back face 115 has, moreover a small prismatic block 132 of a substantially triangular cross-section section through a plane transverse to axis 118 and having two perpendicular faces 130 and 131 connected by an hypotenuse face 133. It has a second block 134 which is diametrically opposite to the first one. The transverse faces, respectively 135 and 136 of both blocks 132 and 134 are very slightly recessed with respect to the extension of the peripheral part 123 of the back face of member 53. The front face 138 of member 53 has a peripheral front rib 137 which projects from the rest of the front face except for intervals 139 and 140 provided by the extremities 64 and 66 on the one hand, and 65 and 67 on the other hand.

A circular protective plate 350 (figure 6') is applied onto the front face 138, its thickness being equal to the distance from face 138 to the transverse face of the rib 137, and fits into the ribs 62 and 63. This protective plate has ears 351 and 352 which come into the intervals provided between the end faces 64, 66 and 65, 67 of the ribs 62 and 63. The protective plate 350 is perforated substantially along the same pattern as openings 82, 83, 84, 86, 87, 89.

The member 55 (FIGS. 7 and 8) adjacent to member 53, is also generally disk-shaped, some what less thick than disk 53, with an external surface 141 extending the external surface 59 of member 53 and a front face 152 having an upper part 153 and a lower part 153' coming in close contact with the upper part 123 and the part 123', respectively.

The peripheral portion of member 55 has also a cylindrical groove 154, of a span slightly less than half a circle, with an axis parallel to the diametrical plane 118 and which, when member 55 is adjacent member 53, makes with the groove 121 of said member a quasi-circular hole obturated at one end by the bottom part 127 of the groove 121 and a bottom part 155 of the groove 154. Member 55 also has on its front face 152 a lower groove 156 having a span less than half a circle and which, when adjacent to member 53, makes with the groove 121' of this latter a circular hole, the bottom part 157 of said hole being diametrically opposite to bottom 155. The hole 156 opens freely at 158 at its other end.

Member 55 has a through passage 159 having the same pattern as the through passage 81 of member 53 and which extends the same.

Moreover, it has on the central portion 161 of its front transverse face and recessed with respect to parts 153 and 153', a prismatic block 162 of same pattern as block 132. It has on its back face 163 a prismatic block 164 of same pattern as the prismatic block 162, and symmetrical of the latter with respect to the axis of the member as well in its arrangement as in its shape. Member 55 is further transversed by cylindrical passages 170 and 171 which extend respectively the cylindrical passages 113 and 113' of member 53.

On its back face, member 55 has an upper groove 172 and a lower groove 173, the bottom part 174 of which is symmetrical to th bottom of the groove 172 with respect to the axis of the member. The back face 163 has an upper part 175 and a lower part 175' projecting from the central portion 176.

Member 55 has diametrically opposite rectangular notches 177 and 178 which extend the rectangular notches 68 and 69 of member 53.

Member 56 (FIG. 9 and 10) has a structure similar to that of the hereabove described member 55, except that the groove arrangements are symmetrical with that of grooves of member 53, so that when the front face 180 of the member 56 is adjacent to the back face 163 of the member 55, the groove 172 of member 55 makes with groove 181 a hole the bottom 181' of which results from the joining of the groove bottom parts, things being identical for the lower groove 182 of the member 56 which makes a bottom part 182' when adjacent to the groove 173 of the member 55.

FIG. 10 shows a prismatic block 183 provided on the front face 180 and a prismatic block 184 provided on the back face 185 of member 56.

Cylindrical bores 186 and 187 of member 56 extend respectively the cylindrical passages 170 and 171 of member 55. Similarly, the rectangular notches 188 and 189 extend the rectangular notches 177, 178 and 68, 69 of members 55 and 53. A passage 190 with central channel and horizontal shanks extends the channel 159 of member 55.

Member 57 has the same constitution as member 55 and member 58 has the same constitution as member 56.

Member 54 (FIGS. 11 and 12) has on its front face 191 upper and lower grooves 192 and 193 and prismatic blocks 194 and 195. Its back end has a circular rib 196 the front edge of which cooperates with the recess 9 of the cylinder 2. Member 54 has a through passage 198 which extends the passage 190. The member 54 has a through passage 198 which extends the passage 190. Member 54 is, moreover, traversed by cylindrical holes 198' and 199' which extend respectively cylindrical holes 186 and 187 of the member 56. The member 54 carries the device actuating the lock mechanism 199.

When member 55 is placed against member 53, the upper part 153 of member 55 coming against the upper part 123, and the lower part 153' coming against the lower part 123', a housing is provided between both members, this housing being limited by the back face in recess in its portion non peripheral to the member 53 and the front portion in recess in its portion non peripheral to the member 55. In this housing 200 (FIG. 13), a first cam **212*a* is rotatively fitted around a shaft 211 passing through the holes 133', 171, 187 and 199', this first cam being made of a plate and having, in addition to a semi-circular shaped portion 213 co-axial to the shaft 211, a rectilinear portion 214 continued by a rectilinear portion 215, this latter being at an obtuse angle to the first one, a rectilinear portion 216 to a cut-off angle, a circular arc portion 217 of a radius greater than arc 213 and substantially co-axial to shaft 211, an oblique portion 218 being at obtuse angle to arc 217, a curved portion 219 which deviates from the shaft 211 from the junction point 220 with portion 218, a portion 221*a* of front extremity, then a portion 222, curved and followed by a reversely curved part 223, a rectilinear portion 224 which is connected to the circular arc 213 through a curved portion 225**.

The housing 200 contains a second cam **212*b*, identical to the first one, and rotatively fitted around a shaft 226, inserted into the aligned holes 113, 170, 186, 198' and symmetrically arranged with the first cam 212*a*, so that its tail 227*b* is above the mean horizontal plane, while the tail 227*a* limited by lines 219, 221*a*, 222 and 223**, is below said plane.

The upper channel 229 contains a coil spring 230 adapted to cooperate with the extremity front face **227*b* of the cam 212*b* and the other end of which rests on the bottom part 155**.

The lower channel 232 contains a coil spring 223 an extremity of which rests on the bottom part 157 and the other extremity of which is adapted to cooperate with the end front face **221*a* of the cam 212*a***.

A cam **212*c* is rotatively fitted around the shaft 211 into the housing 231 (FIG. 14) provided by the adjacent members 56 and 55, this cam 212*c* having a configuration identical to that of cams 212*a* and 212*b*, but arranged in such a manner that its tail 227*c* is now in the upper portion of the housing 231, but on the other side with respect to the vertical plane, of the tail 227*b* in its housing 200**.

A second cam **212*d* is fitted into the housing 231, this cam having a tail 227*d* in the lower half of the housing 231 just as the tail 227*a* is in the lower half of the housing 200, but symmetrically to the mean vertical plane, the cam 212*d* being rotatively fitted around the shaft 226**.

A coil spring 234 rests on the bottom part 181' of the hole and is adapted to cooperate with the front end of the tail **227*c* of the cam 212*c*. A coil spring 235 is fitted in the other hole, rests on the bottom part 182' and is adapted to cooperate through its other extremity with the front face 221*d* of the cam 212*d***.

Two cams are located inside the housing provided by the adjacent members 58 and 57 and two other cams are also located inside the housing provided by the adjacent members 57 and 56.

The key intended to actuate the lock consists of a body 301 (FIGS. 15 to 17) integral with a key ring (not shown) and the body 301 has a vertical (on the figure) leg 302 from which depend upper horizontal shanks 303 and 304, as well as lower horizontal shanks 305 and 306. The upper shanks 303 and 304 are not mutually aligned. The lower fae 307 of the shank 304 is at a level slightly higher than that of the upper face 308 of the shank 303; similarly, the lower face 309 of the shank 306 is at a level higher than that of the upper face 310 of the shank 305.

Actuation of the lock is obtained by the operational edges 311, 312, 313 and 314, respectively of the horizontal shanks.

FIG. 16 illustrates the key before being cut. For example, the edge 312 of the shank 304 has successive oblique faces 315, 316, 317, 318 connected by faces 319 parallel to the mean vertical plane 320 of the key. Similarly, the edge 314 has oblique faces 321, 322 . . . etc. connected by faces 323 parallel to the plane 320.

Cutting in alignment of a vertical plane 324 of the edge of the key 312, the plane 324 being a symmetry plane for face 319, is simply carried out by milling along lines such as shown in 325, 325', 325" (FIG. 18). The tooth 326 limited by the sides 315, 319 and 316 is thus cut according to different depths and it is the bottom part 327, 327' or 327" of the cut according to the case, which is operational for opening the lock.

The leg 302 of the key is extended by a crest 330. The key body 301 is connected to the ring device 331 by a neck 332.

The operation is as follows:

For opening the lock, the key is first inserted through a longitudinal movement by presenting it with its extremity in front of the key-hole 21. The key moves forward being guided by its crest 330 into appendices or recesses such as 109 provided by passages 81, 159, 190, 198 and its shanks circulate inside the barrel made of the stacking of members 53, 55, 56 and 54, due to the cutting of said members along the horizontal shanks 83, 84, 86, 87 of the member 53 and the analog horizontal shanks of other members.

The cut edges 311, 312, 313, 314 of shanks 303, 304, 305, 306 of the key move in front of edges of the cams which, when the key is not inserted in the lock, partially obturate the passage horizontal shanks: the head 251*a* of the cam 212*a* obturates the upper horizontal shank of the passage, the cam 212*a* being pushed by the coil spring 233 acting on tail 227*a*. The lower horizontal left passage is obturated by the head 251*b* of the cam 212*b*. The lower right passage is obturated by the head 251*c* of the cam 212*c* and the upper horizontal left passage is obturated by the head 251*d* of the cam 212*d*.

On the left part of FIG. 13, the cam 212*b* has been illustrated in the position taken before introducing the key into the lock; the action of the spring 230 on the tail 227*b* drives back the cam 212*b* so that its resting face 214*b* cooperates with the face 135 of the small block 134 which features the member 53 and with the similar face of the small block 164 which features the member 55. In this state, the head 251*b* completely obturates the left lower horizontal passage.

The right half of FIG. 13 shows what is the position of the cam 212*a* when, the key being into the lock, a non cut tooth of its upper shank is in front of the head 251*a*. In this position, the head 251*a* is practically completely free of the right upper horizontal shanks of the key passages provided by members 53 and 55, the rotation of the cam 212*a* around the shaft 211 taking place against the action of the spring 233.

FIG. 14 also shows on its left half a cam 212*d* in its completely retracted condition with respect to the upper horizontal shank of the key passage and, on the contrary, a cam 212*c* in a position where its head 251*b* obturates completely the right lower shank of the passage.

When the key is completely inserted into the lock position in which its neck 332 is in front of the edge of the key-hole 21, each cam contained into the barrel takes an angular position where its edge 215, under the action of the spring on the cam tail, is in contact with the face 237 cut into the key edge. According to the depth of the cutting, each cam thus takes a preset position. Only in this preset position will a rectangular notch 411 on its circular part 217 be opposite catches 400A and 400B (FIG. 19).

These catches have a some what prismatic cross-section with a bottom 401, two parallel faces 402 and 403 and two oblique faces 404 and 405 having the same angle as that of bevel faces 13 and 14 of notches 12 of the cylinder 1. The length of the catches is substantially equal to that of the stacking of the members which make the barrel.

The key being completely inserted, it is rotated and the reaction of faces 13*a* and 14*b* against faces 405 A and 405B respectively of catches urges upon the latter toward the axis of the barrel. If the key is the one corresponding to the lock, the notches 411*b* and 411*d* are aligned and notches 411*a* and 411*c* are also aligned.

The catches 400A and 400B enter these notches and thus release the notches 12*a* and 12*b* (FIG. 19): the assembly in rotation provided by the catches between the barrel and the cylinder body is then cancelled and the barrel can rotate and actuate the lock device through the driving members 199 of the member 54 : the lock is open.

The notches 411 are made on the cams 212 advantageously on the circular arc 217 at a place depending on the notch 327, 327′, 327″ made on the key.

Closing the lock is obtained by a reverse rotation. At the end of this rotation, the catches 400A and 400B are again in front of the notches 12*a* and 12*b* and, under the action of coil springs which act upon them, they enter through their triangular portions the notches 12*a* and 12*b*, the remaining part of their body being engaged into the rectangular notches 68, 69, 170, 171, 188, 189, 421 and 422 of members 53, 54, 55 and 56.

By pulling out the key, the cams are urged according to small oscillating movements as the cut portions of the key move before their actuating part 215. As soon as the key does not longer pass before a cam the latter comes back to its position as shown for cams 212*b* and 212*c* in FIGS. 13 and 14 under the action of the springs acting upon their tails. What is claimed is:

1. A safety lock comprising; a cylinder having a transverse end wall provided with an opening for the entrance of a key, a barrel within said cylinder, a number of notched cams located in transverse planes of the barrel and pivotally mounted around at least one axis extending parallely to the longitudinal axis of the lock, at least one longitudinal catch mounted between said barrel and said cylinder, and adapted to be received into said notches when they are aligned, thereby rotatively freeing the barrel with respect to the cylinder, and an aperture extending longitudinally into said barrel for said key the introduction of which within said barrel displaces said cams by acting on the portions thereof projecting into said axially directed aperture the latter having a central channel and two couples of shanks extending substantially perpendicularly to said channel, the shanks of each couple being offset with respect to one another.

2. A lock according to claim 1, wherein the shanks of the couples are so positioned that for each couple the lower boundary wall of one shank is substantially in alignment with the upper boundary wall of the other shank.

3. A key for actuating a lock according to claim 1, comprising a substantially flat body of a cross section corresponding to that of the central channel of the barrel aperture and on each side of said body shanks offset with respect to one another and having on their edges adapted to cooperate with that parts of the cams of the lock which project into said aperture.

4. A key according to claim 3, wherein said shanks extend substantially perpendicularly to the body.

5. A key according to claim 4, comprising on each side of the body, two upper shanks and, on each side of the body, two lower shanks, the upper shanks being offset in height and the lower shanks being offset in height with respect to one another.

6. A key according to claim 5, wherein a couple of shanks, the lower edge of one shank is substantially at the same level as the upper edge of the other one.

* * * * *